United States Patent [19]

Chen

[11] Patent Number: 4,761,835

[45] Date of Patent: Aug. 9, 1988

[54] INFORMATION INDICATING GLOVE

[76] Inventor: Si-Fong Chen, Room A, 10F, No. 344, Min Sheng E. Road, Taipei, Taiwan

[21] Appl. No.: 59,947

[22] Filed: Jun. 9, 1987

[51] Int. Cl.[4] ..... A41D 19/00

[52] U.S. Cl. ..... 2/160

[58] Field of Search ..... 2/160, 161 A, DIG. 6; 224/170

[56] References Cited

U.S. PATENT DOCUMENTS 825,510 7/1906 Bloc et al. ..... 2/160

1,612,055 12/1926 Rice ..... 2/160

4,281,389 7/1981 Smith ..... 2/160

4,387,838 7/1983 Jackson ..... 224/170

*Primary Examiner*—Henry S. Jaudon

*Attorney, Agent, or Firm*—Morton J. Rosenberg

[57] ABSTRACT

At least one information indication article, like a battery-activated watch, a compass, a thermometer, etc. is detachably or undetachably disposed in an information indication piece on the wrist and back of a glove portion in a conventional form. One end of the information indication piece is secured with a tightening ring. This ring and a tightening strip provided with Velcro fastener arrangements secure the glove on the user's wrist and dispose the information indication piece in a preferred observation orientation.

2 Claims, 6 Drawing Sheets

INFORMATION INDICATING GLOVE

BACKGROUND OF THE INVENTION

The present invention relates to a glove wherein at least one information-indication means, like a watch, is disposed within a tightening strips portion of the glove so as to enable the user to read the information from the back of the glove.

When the washer is cold, thermal gloves are quite necessary for people who are involved in outdoor activities, to keep their hands warm. Since gloves for keeping warm are often heavy and sleeved, a user of this type of glove often encounters the problem that his wristwatch is covered by his glove. Therefore, the wristwatch is not conveniently observable and is ineffectual. Although some thermal gloves are not sleeved, the same inconvenient situation still commonly occurs because in cold weather, long-sleeved clothes cover the watch. Therefore, people who wear heavy clothes and gloves can not effectively and easily read the time from their wrist watches while outdoors. Accordingly, an easy-to-read time indicating glove is desirable and would actually solve this troublesome problem. Further, people working outdoors often find it necessary to use a compass and/or a thermometer to indicate direction and temperature, respectively. However, it is very difficult to reach and hold the compass or thermometer with gloved hands, and it is also very troublesome to remove one's gloves and to handle the articles with one's bare hands. Therefore, a glove comprising an easy-to-observe information indication means on its back portion is quite desirable.

SUMMARY OF THE INVENTION

A primary objective of the present invention is therefore to provide a glove which enables people to conveniently read information like time, direction, temperature, etc. while wearing heavy clothes and gloves.

Another objective of the present invention is to provide an information-indicating glove wherein at least one information indication means like a battery-activated watch, a compass, a thermometer, etc. is detachably or undetachably disposed within a tightening strip portion located on the back of the glove.

Further objectives and advantages of the present invention will become apparent as the following description proceeds, with reference to the accompanying drawings.

DETAILED DESCRIPTION OF THE PREFERRED EMBODIMENTS

Figure 1:
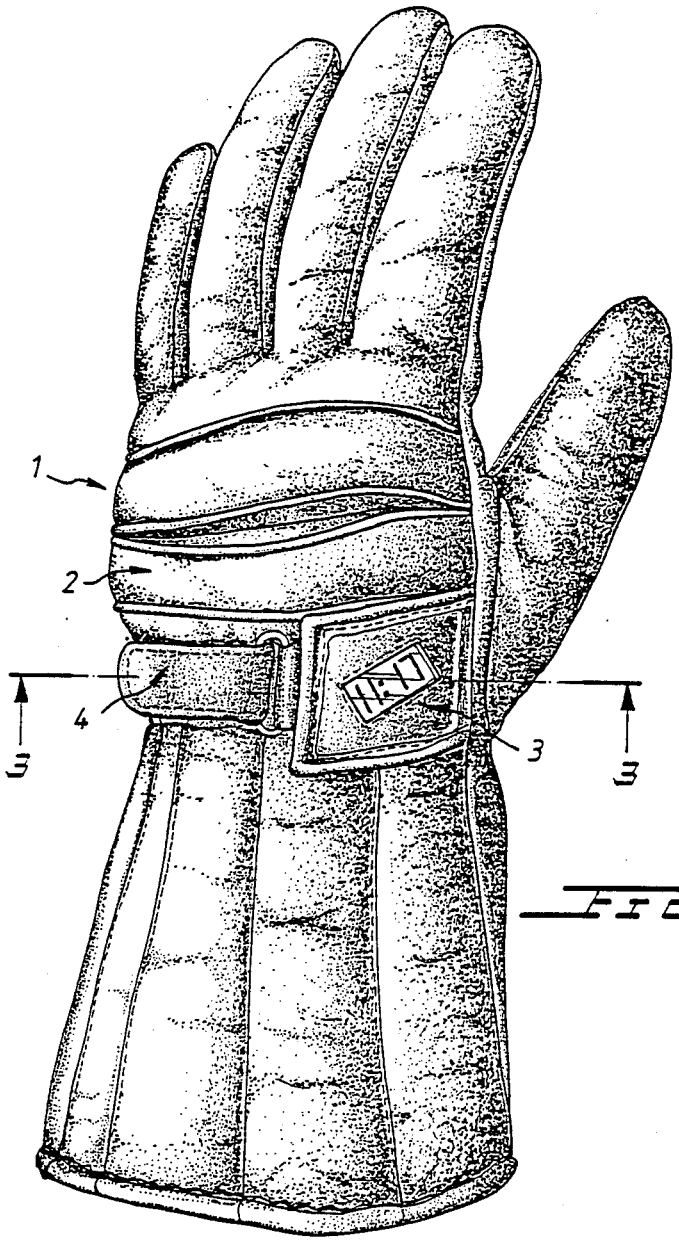
FIG. 1 is a perspective view of a first embodiment of an information-indicating glove according to the present invention.
Figure 2:
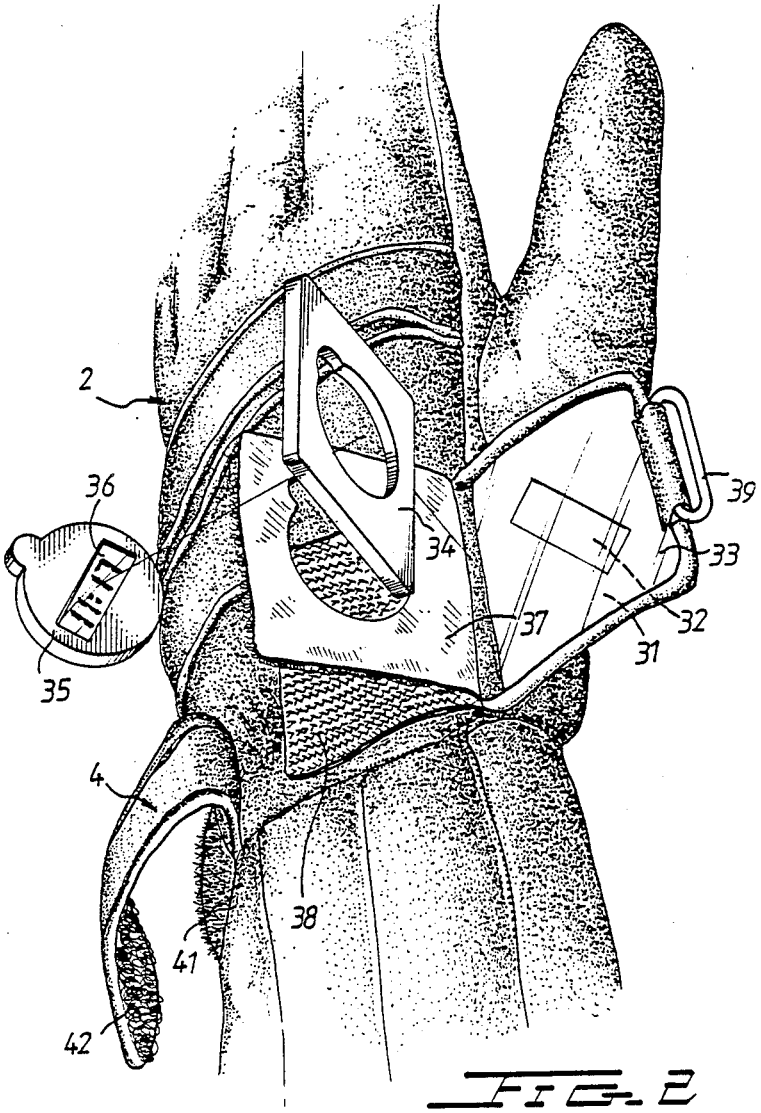
FIG. 2 is a partially exploded view of the glove shown in FIG. 1, showing the constitution of the information indication piece of the glove.

Referring to FIGS. 1 and 2, it can be seen that the information-indicating glove generally designated by the reference numeral 1, as a first embodiment of the present invention, comprises a glove portion 2, and a tightening strip portion including an information indication piece 3 and a tightening strip 4.

The glove portion 2 has the same configuration as conventional gloves, which may be one of several different designs available in the market. For instance, the glove portion 2 may include a fingered portion for separately receiving four fingers and a thumb portion, or the glove portion 2 may be mitten-like, with the four fingers being enclosed together. Furthermore, the glove portion 2 may optionally include a sleeve. The glove portion 2 may be right-handed or left-handed.

Figure 3:
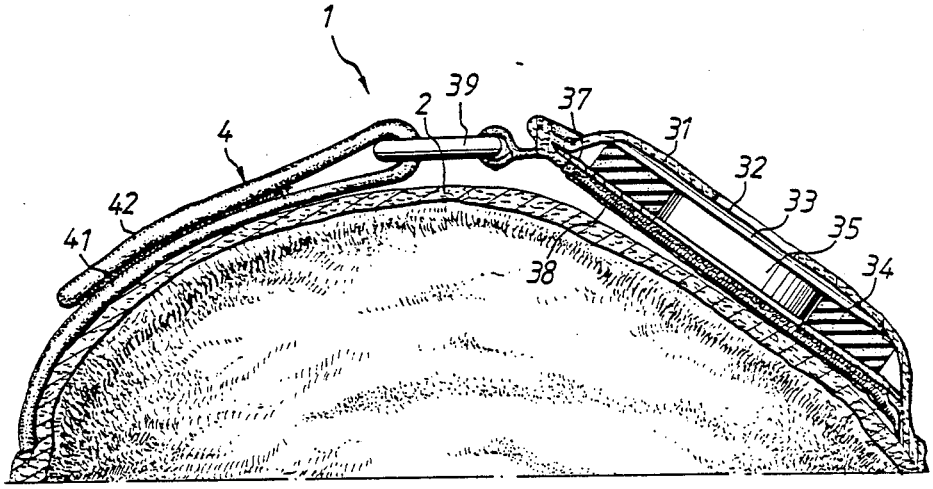
FIG. 3 is a partial cross-sectional view of the top half of the glove taken from line 3—3 in FIG. 1.

Referring to FIGS. 2 and 3, it can be seen that the information indication portion 3 includes a rectangular observation cover 31 whose middle portion is provided with an observation slot 32. The observation cover 31 has one edge attached to an appropriate position of the wrist of the glove close to the thumb portion. A transparent plate 33 is disposed inside the observation cover 31 in order to prevent the information indication means disposed therein from getting wet. An information indicator support 34, whose middle portion is provided with an aperture in accordance with the shape of the watch to be received, is disposed inside the transparent plate 33. A battery-activated watch 35 (only as an example in this case, replaceable by another information indication means like a compass, a thermometer, etc.) is disposed within the watch support 34, with the liquid crystal display (LCD) screen 36 thereof facing the observation slot 32. It is noteworthy that the watch 35 can have a conventional watch face instead of the above-mentioned LCD screen. Furthermore, the shape of the observation slot 32 on the observation cover 31 is also in accordance with the time-indicating screen 36 of the watch 35. A support tab 37, whose middle portion is also provided with an aperture for the passage of the watch 35, has its perimeter secured to that of the observation cover 31. Therefore, the observation cover 31, the transparent plate 33, the watch support 34 and the support tab 37 are secured together. However, the watch 35 may be disposed within or taken off the watch support 34 via the centered aperture of the support tab 37. The rear face of the support tab 37 opposite to the observation cover 31 is provided with a Velcro (trademark name) strip fastener. A securement flap 38, whose inner face is proximate to the support tab 37, is provided with the Velcro strip fastener, with one edge of the securement flap 38 attached to the same position of the glove where the observation cover 31 is attached. The Velcro strip fastener of the securement flap 38 is attached to that of the support tab 37 after the watch 35 is put into the watch support 34 via the support tab 37. If the battery of the watch 35 runs out and the watch 35 needs to be detached from the information indication portion 3, then it is only necessary to detach the securement flap 38 from the support tab 37. It is very easy to detach the Velcro fasteners of the engagement flap 38 and the support tab 37 from each other. The watch 35, or another information-indication means, can hence be directly taken out of the information indicator support 34 via the support tab 37. It is also quite easy to put a watch 35 into the watch support 34 by reversing the above-mentioned 25 procedures. A tightening ring 39 is secured to the edge of the observation cover 31, which is remote from the glove portion 2 when in open position (as shown in FIG. 2). A tightening strip 4 is set on an appropriate position of the wrist of the glove back, opposite to the information indication portion 3. The tightening strip 4, together with the tightening ring 39, is used for tightening the wrist portion of the glove, thereby securing the glove to the hand. The top surface of the lower and upper portions 41 and 42 of the tightening strip 4 are provided with Velcro fasteners. Accordingly, the upper portion 42 of the tightening strip 4, after going through the tightening ring 39, can be attached to the lower portion 41 of the tightening strip 4. One other optional feature of this invention is that the watch 35 can be provided with a notch which matches a protrusion on the aperture of the watch support 34. This keeps the watch 35 in the optimum orientation (i.e. the watch can't slide around).

Figure 4:
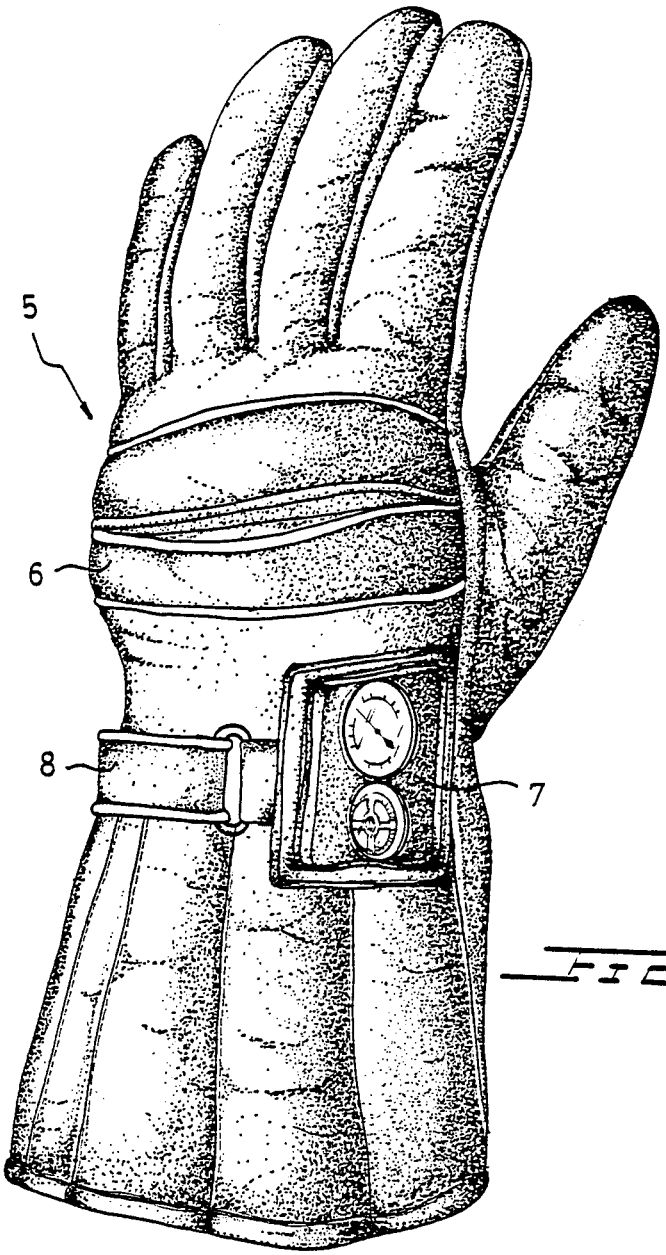
FIG. 4 is a perspective view of a second embodiment of the information-indicating glove according to the present invention.
Figure 5:
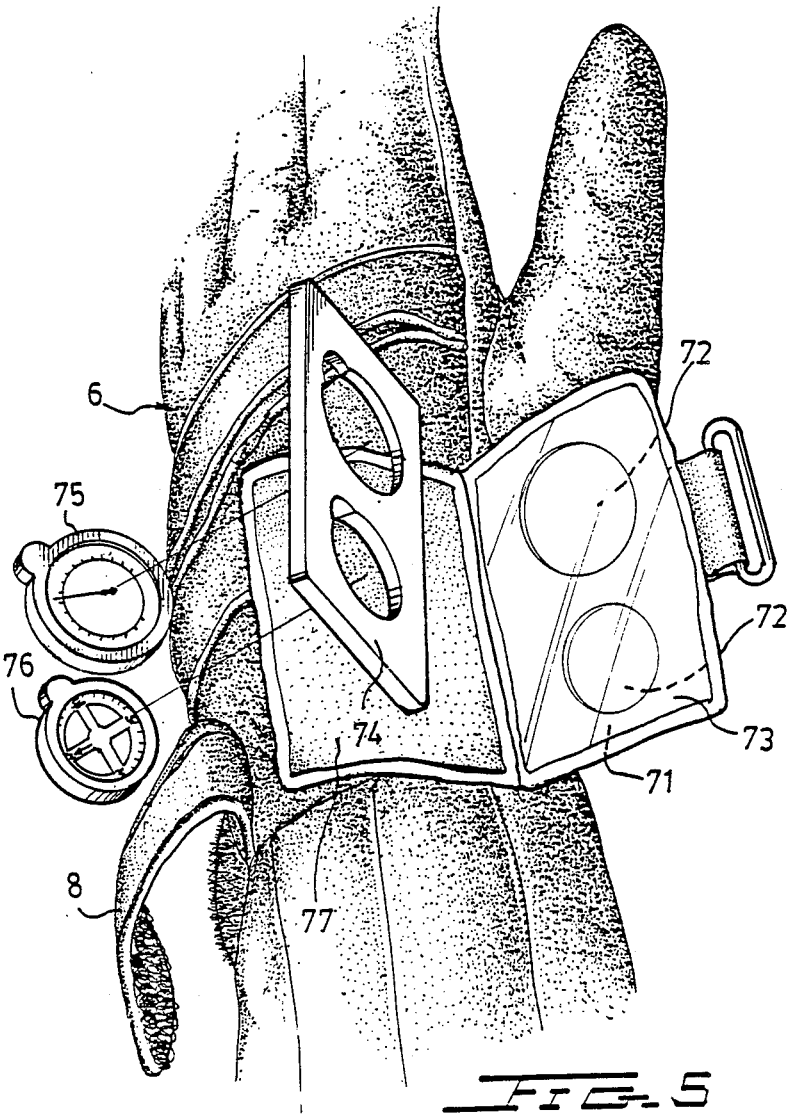
FIG. 5 is a partially developed view of the glove shown in FIG. 4.
Figure 6:
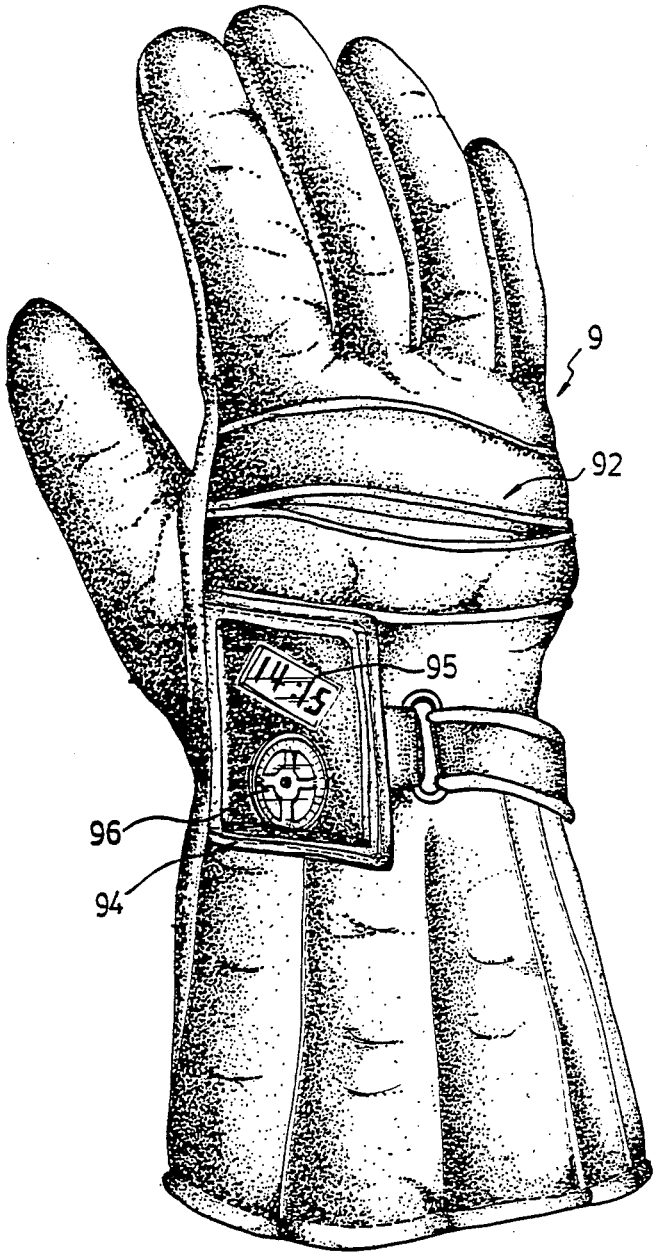
FIG. 6 is a perspective view of a third embodiment of the information-indicating glove according to the present invention.

Referring to FIGS. 4 and 5, a second embodiment of the information-indicating glove, generally designated by the reference numeral 5, according to the present invention can be clearly seen. The information-indicating glove 5 comprises a glove portion 6, and a tightening strips portion including an information indication piece 7 and a tightening strip 8. The glove portion 6 and the tightening strip 8 have the same configuration as those of the afore-described glove 1 shown in FIGS. 1 to 3. The information indication piece 7 is substantially identical to the information indication piece 3 as shown in FIGS. 1 to 3, but the information indication means disposed in either indication piece 7 or 3, and the securement method of either indication piece 7 or 3 are different. The information indication means disposed in the information indication piece 7 includes a compass 75 and a thermometer 76. An information indicator support 74 provided with apertures formed according to the figures of the compass 75 and the thermometer 76 retains the compass 75 and the thermometer 76 between the transparent plate 73 and the securement flap 77. The observation cover 71 provided with observation slots 72 is sewn together with the securement flap 77 so as to secure the transparent plate 73, the information indication means 75 and 76, and the information indicator support 74 therebetween. Alternatively, the members disposed in the information indication piece 7 can be secured thereto by the detachable securement method of Velcro fastener as described in the first embodiment 1 shown in FIGS. 1 to 3. The information indication means, a compass and a thermometer in this case, could alternatively be replaced with other means providing useful information. The number of the information indication means is at least one and not limited to two. For purposes of illustration, a third embodiment of the information indication glove, according to the present invention, generally designated by 9 is described hereinafter with reference to FIG. 6. The glove portion 92 of the glove 9 is in a right-handed form. The information indication means disposed in the information indication piece 94 includes a watch 95 and a compass 96.

As various further possible embodiments might be made of the above invention, and as various adaptations might be made in the embodiment above set forth, it is to be understood that all matter herein described or shown in the accompanying drawings is to be interpreted as illustrative and not in a limiting sense. Thus it will be appreciated that the drawings are exemplary of preferred embodiments of the invention.

I claim:

1. An information-indicating glove comprising:

a glove portion;

an information indication portion including:

an observation cover, one edge thereof being attached to said glove portion, a transparent plate disposed inside said observation cover, at least one information indication means, an information indicator support disposed inside said transparent plate and provided with at least one aperture retaining said information indication means, a securement flap with one edge thereof attached to said glove portion, said securement flap being secured to said observation cover, and a tightening ring secured to an edge of said observation cover remote from said glove portion; and a tightening strip set on said glove portion opposite to said information indication portion, said tightening strip being provided with Velcro fasteners on inner surfaces of an upper portion and a lower portion thereof.

2. The information indicating glove of claim 1, further comprising:

a support tab disposed inside said information indicator support and attached to said observation cover, said support tab being provided with at least one aperture for passage of said information indication means, a rear face of said support tab being provided with a Velcro fastener; and an inner face of said securement flap being provided with a Velcro fastener.

* * * * *